US006164215A

United States Patent [19]

Cook et al.

[11] Patent Number: 6,164,215

[45] Date of Patent: Dec. 26, 2000

[54] DUAL-HEIGHT SHELF DIVIDER

[75] Inventors: Deborah Ann Cook, Huntington Beach, Calif.; Marvin L. Runge, Edgerton, Wis.

[73] Assignee: Spacesaver Corporation, Fort Atkinson, Wis.

[21] Appl. No.: 09/356,173

[22] Filed: Jul. 16, 1999

[51] Int. Cl.[7] ..... A47B 57/00

[52] U.S. Cl. ..... 108/60; 211/184

[58] Field of Search ..... 108/60, 61; 211/183, 211/184, 43

[56] References Cited

U.S. PATENT DOCUMENTS

| | | | |
|---|---|---|---|
| 567,003 | 9/1896 | Poindexter | 211/184 X |
| 2,604,213 | 7/1952 | Bales et al. | 211/183 X |
| 3,160,282 | 12/1964 | Gunn | 211/184 |
| 3,269,558 | 8/1966 | Hess | 211/184 |
| 3,905,484 | 9/1975 | Dean et al. | 108/60 X |
| 4,595,105 | 6/1986 | Gold | 211/184 X |
| 4,858,774 | 8/1989 | Winter et al. | 211/184 |
| 4,889,397 | 12/1989 | Ryan | 108/60 X |
| 5,148,927 | 9/1992 | Gebka | 108/60 X |
| 5,971,173 | 10/1999 | Valiulis et al. | 211/184 |

*Primary Examiner*—José V. Chen

*Attorney, Agent, or Firm*—Andrus, Sceales, Starke & Sawall, LLP

[57] ABSTRACT

A shelf divider adapted for mounting within shelf spaces of differing heights generally includes a divider member defining a series of edges. Engagement tabs extend from the edges, and include a first pair of tabs on one edge and a second pair of tabs on another edge. A stabilizing tab extends from an edge opposite the first pair of tabs, and a stabilizing tab also extends from an edge opposite the second pair of tabs. Each shelf member includes a row of slots in an upper support wall, and also includes a row of slots in a lower, downwardly facing wall. The shelf divider is dimensioned and configured such that it can be positioned in a first orientation and engaged within a shelf space having a first height, by engaging the first pair of tabs with slots in the lower shelf member and engaging the oppositely-located stabilizing tab within the downwardly facing slot in the shelf member thereabove. The same shelf divider can also be used to divide a shelf space having a different height by positioning the shelf divider in a second orientation in which the second pair of tabs are received within the slots in the lower shelf member of the second shelf space. The oppositely-extending stabilizing tab is received within the downwardly facing slot in the shelf member located thereabove for stabilizing the shelf divider against lateral forces.

15 Claims, 3 Drawing Sheets

DUAL-HEIGHT SHELF DIVIDER

BACKGROUND AND SUMMARY OF THE INVENTION

This invention pertains to shelving, and more particularly to a shelf divider.

Shelf dividers are well known, and are typically positioned at intervals along the length of a shelf space to provide lateral support for articles positioned on the shelf. A typical shelf divider is in the form of a stamped piece of sheet metal which defines a series of edges. A pair of lower tabs extend from a lower edge, and a top tab extends from an upper edge. The lower tabs are received within slots formed in the lower shelf defining the shelf space, and the top tab extends into a slot formed in the underside of the upper shelf defining the shelf space. This mounting arrangement provides secure engagement of the divider with the shelves, to maintain the divider in position and prevent movement of the divider under the influence of lateral forces.

While the above-described shelf divider construction has been found satisfactory, it is necessary to provide shelf dividers of different heights for shelf spaces which vary in height. This is especially the case when it is desired to divide the shelf space throughout its full height, in that a separate height divider is required for each possible shelf height. This requires manufacture and distribution of shelving dividers having many different heights, which is somewhat cumbersome and inefficient.

It is an object of the present invention to provide a shelf divider which is adapted for use with shelf spaces of differing heights so as to eliminate the need to manufacture and distribute a single shelf divider for each available shelf space height. It is a further object of the invention to provide such a shelf divider which is manufactured and installed in a manner similar to shelf dividers of existing design. Yet another object of the invention is to provide such a shelf divider which provides a similar function and appearance as existing shelf dividers.

In accordance with the invention, a shelf divider is adapted for use in combination with a shelf arrangement which includes a lower shelf member in combination with an upper shelf member and a shelf back. The shelf divider includes divider structure in combination with engagement structure which is capable of engagement with the lower shelf member when the shelf divider is either in a first orientation or a second orientation relative to the lower shelf member. The engagement structure is further adapted to provide lateral support for the shelf divider when the shelf divider is either in its first orientation or its second orientation. In one form, the shelf divider is dimensioned so as to extend substantially the full height of a shelf space between the upper and lower shelf members when the shelf divider is either in its first orientation or its second orientation.

The engagement structure may be in the form of a series of tabs extending from edges defined by the divider structure which are adapted for engagement within slots formed in the lower shelf member and in the upper shelf member. In one arrangement, the divider structure defines a first pair of opposed edges and a second pair of opposed edges. The series of tabs include a pair of tabs extending from one of the edges in each of the first and second pair of opposed edges, in combination with a stabilizing tab extending from an opposite one of the edges in each of the first and second pair of opposed edges. The slots formed in the lower shelf member are in the form of a pair of spaced rows of slots. The slots receive the tabs of each pair of tabs to enable the shelf divider to be positioned in either its first orientation or its second orientation relative to the lower shelf member. The slots formed in the upper shelf member are in the form of a row of slots adapted to receive the stabilizing tab when the shelf divider is in either its first orientation or its second orientation. With this construction, one of the pairs of tabs is engaged with selected slots in the rows of slots when the shelf divider is in its first orientation and one of the stabilizing tabs is engaged with a slot in the upper shelf member. The unused pair of tabs is preferably located on an edge of the shelf divider which faces the shelf back. The shelf divider can then be removed from its first orientation by disengaging the pair of tabs from the slots in the lower shelf member and disengaging the stabilizing tab from the slide in the upper shelf member, and repositioned so as to engage the previously unused pair of tabs with selected slots in the lower shelf member and engaging the previously unused stabilizing tab with a slot in the upper shelf member, to engage the shelf divider with the upper and lower shelf members when in its second orientation. The shelf divider is repositioned such that the pair of tabs previously engaged with the slots in the lower shelf member are oriented so as to face the shelf back. In either orientation, the unused stabilizing tab faces forwardly and is preferably located adjacent the lower shelf member.

The invention further contemplates a method of engaging a shelf divider with a shelf arrangement in either a first orientation or a second orientation, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
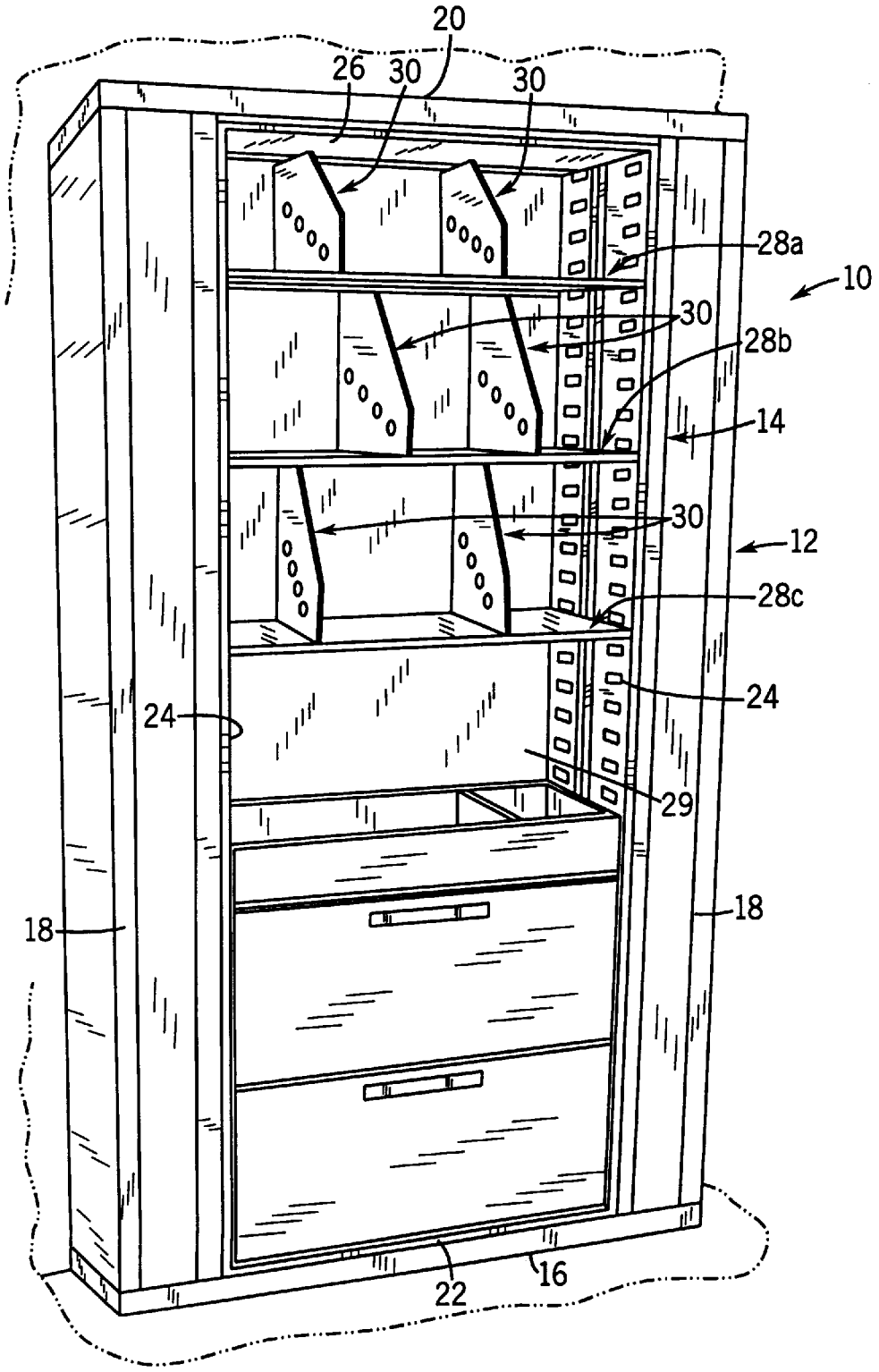
FIG. 1 is an isometric view of a file cabinet incorporating the dual position shelf divider of the present invention.

FIG. 1 illustrates a file cabinet assembly 10 which generally includes a stationary outer cabinet assembly 12 in combination with an inner rotary shelf assembly 14. Outer cabinet assembly 12 includes a base 16, a pair of vertical side panels 18 extending upwardly from base 16, and a top panel 20 which spans between and interconnects the upper ends of side panels 18. Rotary shelf assembly 14 includes a bottom panel 22, a pair of side panels 24 and a top panel 26. A series of shelves 28*a*, 28*b* and 28*c* extend between and are interconnected with side panels 24 and a back panel 29 extends between side panels 24, in a manner as is known. This construction of file cabinet assembly 10 is conventional and known to those skilled in the art.

A series of shelf dividers constructed according to the invention are shown at 30. In a manner as is known, shelf dividers 30 function to divide the space above selected ones of shelves 28*a*–28*c*. Dividers 30 provide lateral support for items supported on shelves 28*a*–28*c*, and are particularly useful when shelves 28*a*–28*c* are employed to support files, books or the like which occupy less than the entire space above a shelf, to prevent such articles from falling over.

FIG. 1 illustrates shelf dividers 30 used in rotary file cabinet assembly 10. However, it should be understood that shelf dividers 30 may be used in any type of shelving, including a conventional non-rotary shelving or storage cabinet or any other application in which a shelf space is defined above a shelf member.

Figure 2:
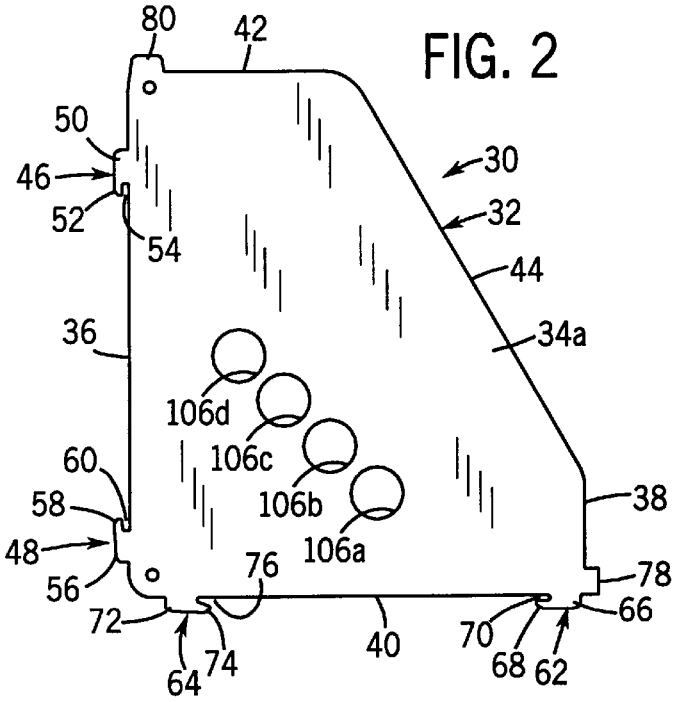
FIG. 2 is a side elevation view of the dual position shelf divider of the present invention adapted for incorporation into a shelf arrangement as in FIG. 1.

As shown in FIG. 2, each shelf divider 30 is in the form of a substantially planar divider structure or member 32. Divider structure 32 may be in the form of a stamped section of sheet metal such as steel, although it is understood that other satisfactory materials and forming methods may be employed. For example, divider member 32 may be formed of a plastic material in an injection molding process.

Divider member 32 defines oppositely facing side surfaces 34*a*, 34*b*, in combination with a first pair of parallel edges 36, 38 and a second pair of parallel edges 40, 42. Edges 40 and 42 are perpendicular to edges 36 and 38, and an angled front edge 44 extends between and interconnects edges 38 and 42. As can be readily appreciated, divider member 32 is dimensioned such that edges 40 and 42 are spaced apart a distance greater than that of edges 36 and 38.

A pair of spaced tabs 46 and 48 extend outwardly from edge 36. Tab 46 includes a main body portion 50 and a lateral projection 52, which cooperates with edge 36 to define a slot 54. Similarly, tab 48 defines a main body portion 56 and a lateral projection 58, which cooperates with edge 36 to define a slot 60 which is shorter in length than slot 54 defined by projection 46. Projections 52 and 58 face each other, as do slots 54 and 60.

In a similar manner, a pair of tabs 62 and 64 extend from edge 40 of divider member 32. Tab 62 is constructed identically to tab 46, including a main body portion 66, a projection 68 and a slot 70. Tab 64 is constructed identically to tab 48, including a body portion 72, a projection 74 and a slot 76. Tabs 62 and 64 are spaced apart from each other the same distance as tabs 46 and 48.

A rectangular stabilizing tab 78 extends outwardly from edge 38. Stabilizing tab 78 is located at the end of edge 38 opposite the intersection of edge 38 with front edge 44, and adjacent tab 62. Similarly, a rectangular stabilizing tab 80 extends outwardly from edge 42 at the end of edge 42 opposite the intersection of edge 42 with front edge 44. One side of stabilizing tab 80 is an extension of edge 36 outwardly of tab 46.

Figure 3:
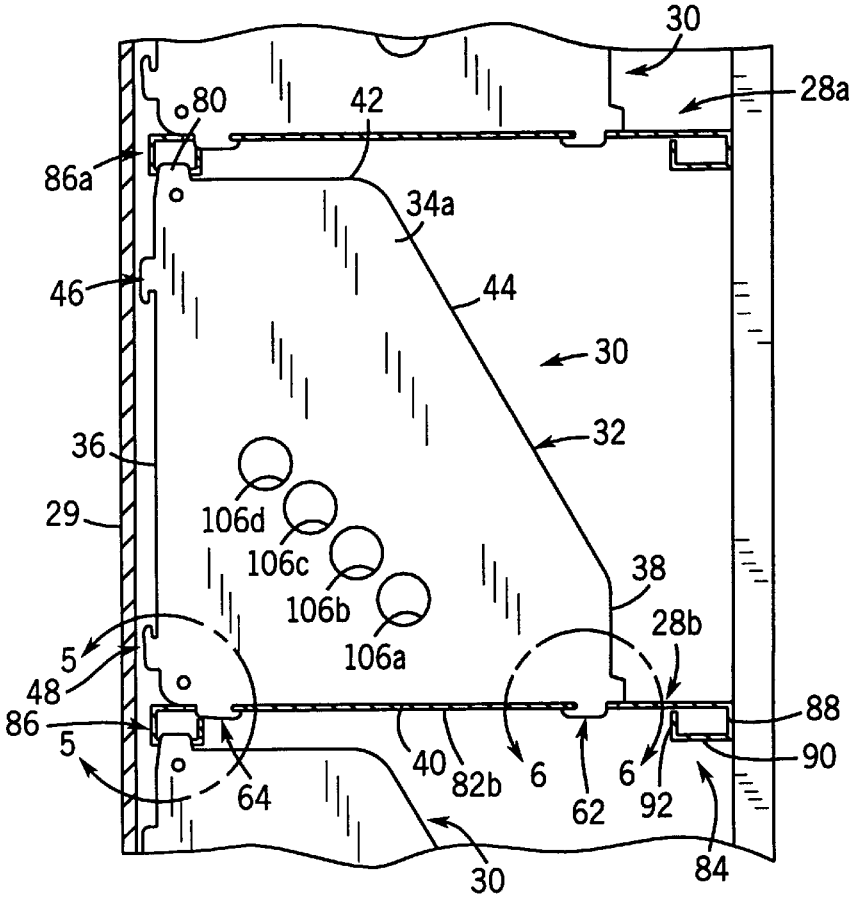
FIG. 3 is a partial section view showing the dual position shelf divider of FIG. 1 in a first orientation in a shelf space having a first height.
Figure 5:
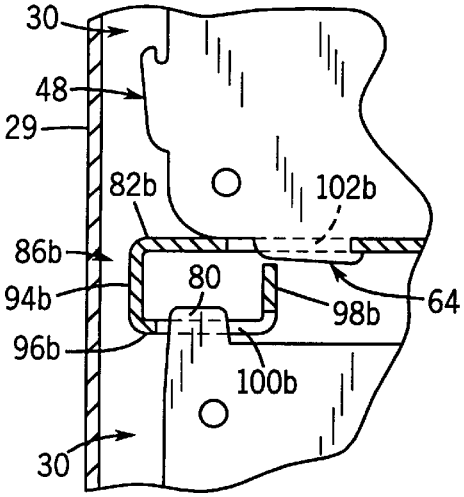
FIG. 5 is an enlarged partial section view with reference to line 5—5 of FIG. 3.
Figure 6:
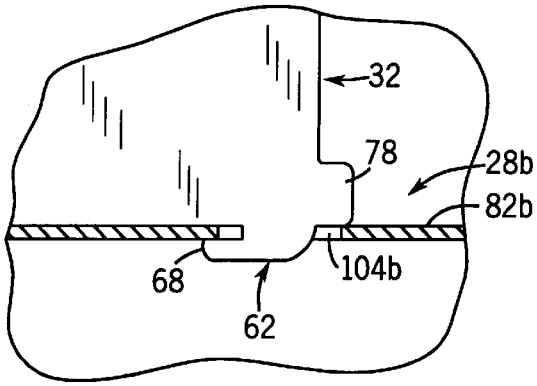
FIG. 6 is an enlarged partial section view with reference to line 6—6 of FIG. 3.

Referring to FIG. 3, shelf 28*b* includes a support wall 82*b* which extends between a front reinforcement section 84*b* and a rear reinforcement section 86*b*. Front reinforcement section 84 defines an outer vertical wall 88*b*, a lower wall 90*b* and an inner vertical wall 92*b*. Similarly, as shown in FIG. 5, rear reinforcement section 86*b* includes an outer vertical wall 94*b*, a lower wall 96*b* and an inner vertical wall 98*b*. A row of aligned downwardly facing slots 100*b* are formed in lower wall 96*b* of rear reinforcement section 86. In addition, a rear row of aligned slots 102*b* is formed in shelf top wall 82*b* adjacent back panel 29. A row of aligned slots 104*b* (FIG. 6) is formed in shelf top wall 82*b* forwardly of rear slots 102*b* and rearwardly of front reinforcement section 84*b* .

Shelves 28*a* and 28*c* are constructed in a manner similar to that described above with respect to shelf 28*b*, and the same reference characters set forth above will be utilized in the following description, with each set of reference characters being modified with a letter corresponding to that of the relevant one of shelves 28*a*–28*d*.

In operation, shelf dividers 30 function as follows to divide a shelf space between two shelves of differing heights.

To divide a shelf space of a first height between shelves 28*a* and 28*b* as shown in FIG. 3, a shelf divider 30 is positioned between shelves 28*a* and 28*b* such that edge 40 faces downwardly and edge 42 faces upwardly. Edge 36 faces rearwardly toward shelf back panel 29. Edge 38 faces forwardly, as does angled edge 44. When shelf divider 30 is in this orientation, divider member 32 extends substantially the full height of the shelf space between shelves 28*a* and 28*b*. Tab 62 is received within a selected one of front slots 104*b* in shelf 28*b*. Tab 64 is engaged within a selected one of rear slots 102*b* in shelf 28*b*, which is in front-rear alignment with the one of front slots 104*b* within which tab 62 is engaged. In addition, stabilizing tab 80 is received within a selected one of slots 100*a* in lower wall 96*a* of rear reinforcement section 86*a* of shelf 28*a*, which is in alignment with the ones of slots 102*b*, 104*b* within which tabs 64 and 62, respectively, are received.

To install shelf divider 30 as illustrated between shelves 28*a* and 28*b*, the user initially inserts shelf divider 30 in the space between shelves 28*a* and 28*b* and engages tab 62 within a selected one of front slots 104*b*. The user than aligns stabilizing tab 80 with a selected one of slots 100*a*, which is in front-rear alignment with the one of slots 104*b* within which tab 62 is received, and pushes divider 30 rearwardly such that tab 80 moves into the selected slot 100*a*. During such movement of divider 30, the rear edge of slot 104*b* is received within slot 70 defined by projection 68 of tab 62. Once divider 30 is positioned sufficiently rearward, tab 64 falls into the one of rear slots 102*b* in alignment with the slots 104 and 100 within which tabs 80 and 62, respectively, are received. The user then pulls shelf divider 30 forwardly to receive the front edge of rear slot 102*b* within slot 70 defined by projection 68 of tab 64. Divider 30 is thus engaged at two locations with shelf 28*c* by engagement of tabs 62 and 64 within slots 104, 102, respectively, and with shelf 28*a* by engagement of stabilizing tab 80 within slot 100*a*. This three-point engagement of shelf divider 30 is operable to brace shelf divider 30 against lateral forces and to securely maintain shelf divider 30 in position between shelves 28*c* and 28*d*. Shelf divider 30 is removed from between shelves 28*c* and 28*d* simply by reversing the above-described steps.

Figure 4:
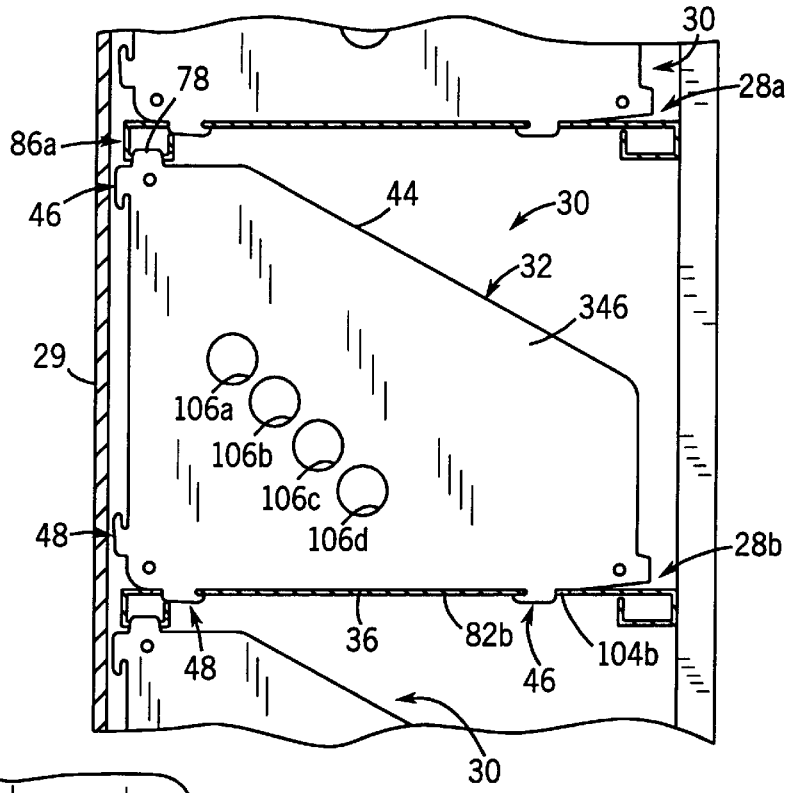
FIG. 4 is a view similar to FIG. 3, showing the dual position shelf divider in a second orientation in a shelf space having a lesser height than that illustrated in FIG. 3.

To utilize shelf divider 30 in a shelf space between shelves 28*a* and 28*b*, which has a lesser height than illustrated in FIG. 3, the user positions shelf divider 30 such that shelf divider 30 is flipped side to side and rotated relative to the orientation of shelf divider 30 as described above between shelves 28*c* and 28*d*. In this orientation, as shown in FIG. 4, divider member 32 has a height which spans substantially the entire height between shelves 28*a* and 28*b*. Shelf divider 30 is preferably dimensioned such that, when positioned in either of the two positions as shown, shelf divider 30 can be used with a majority of the shelf heights commonly employed in conventional shelving applications. Representatively, it is estimated that a shelf divider having a dimension of 9⅞ inches between edges 36 and 38 and a dimension of 11⁹⁄₁₆ inches between edges 40 and 42 will be usable for over ninety percent of applications in which shelf dividers are typically utilized (i.e. for conventional shelf spaces of 10 inches and 11¾ inches in height, respectively).

As noted above, the spacing between tabs 46 and 48 is the same as the spacing between tabs 62 and 64. Accordingly, tabs 46 and 48 are received within slots 104*b*, 102*b*, respectively, in the same manner as described above with respect to tabs 62 and 64, respectively. In addition, stabilizing tab 78 is received within a selected one of slots 100*a* in the same manner as described above with respect to tab 80.

As can be appreciated, the unused one of tabs 78 and 80 faces forwardly from its respective edge 38, 42, respectively, when shelf divider 30 is installed. The unused ones of tabs 46, 48 and 62, 64 face rearwardly toward back panel 29, and thus the only difference in outward appearance between shelf divider 30 and conventional shelf dividers is the presence of the forwardly extending unused one of projections 78 and 80, which does not interfere with the aesthetics or functionality of shelf divider 30.

Divider member 32 includes a series of openings 106*a*, 106*b*, 106*c* and 106*d*, which are arranged in a generally linear pattern, such that a line along which openings 106*a*–106*d* extend forms an acute angle with each of edges 36 and 40. With reference to FIG. 3, openings 106*a*–106*d* are offset from each other both in a front-to-rear direction as well as a bottom-to-top direction. Each of openings 106*a*–106*d* is adapted to receive a tubular member backstop member (not shown) formed in other shelf dividers 30 engaged with shelves 28*a* and 28*b*. With this arrangement, the effective depth of the shelf space can be moved forward from back panel 29 to accommodate files or other items which do not require the full depth of the shelf space.

As shown in FIG. 4, openings 106*a*–106*d* are reversed in orientation when shelf divider 30 is positioned between shelves 28*a* and 28*b* defining a shelf space of lesser height. When shelf divider 30 is in this position, openings 106*a*–106*d* remain in a similar horizontal and vertical offset, to accommodate receipt of a backstop member in a graduated manner to shorten the effective depth of the shelf space. It can thus be appreciated that the orientation of openings 106*a*–106*d* is operable to allow a user to effectively shorten the shelf space depth when shelf divider 30 is in either of its orientations as described above.

Figure 7:
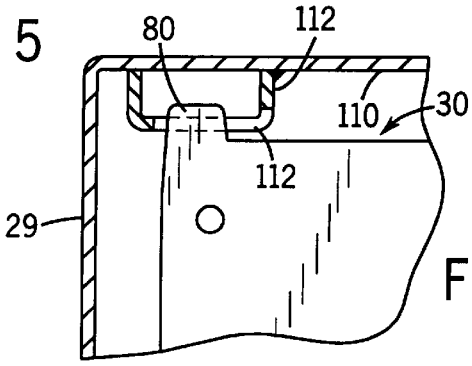
FIG. 7 is an enlarged partial section view showing engagement of the upper end of the shelf divider of FIG. 2 at the upper extent of the shelf space defined by the cabinet of FIG. 1.

FIG. 7 illustrates a top panel 110 of rotary shelf assembly 14. When positioning a shelf divider 30 in the upper shelf space of rotary shelf assembly 14, the stabilizing tab such as 80 is received within one of a series of slots 112 formed in a U-shaped top member 112 mounted to the downwardly facing surface of top panel 110. Top member 112 thus takes the place of the underside of a shelf as described previously, which includes slots 100 for receiving stabilizing tabs 78, 80 to mount a shelf divider 30 within the upper extent of the shelf space defined by rotary shelf assembly 14.

It can thus be understood that shelf divider 30 is easily and readily adaptable for use with different shelf heights and provides a simple, economical shelf divider structure for use in shelf spaces of differing heights. Shelf divider 30 is of similar general construction as existing shelf dividers, and involves little modification of manufacturing or tooling processes for manufacture. The ability of shelf divider 30 to divide shelf spaces of differing heights allows manufacture of a single shelf divider where it was previously required to manufacture two different shelf dividers, and also enables a distributor to stock a lesser number of parts than was previously required. Shelf divider 30 thus provides significant efficiencies in manufacture and distribution.

Various alternatives and embodiments are contemplated as being within the scope of the following claims particularly pointing out and distinctly claiming the subject matter regarded as the invention.

I claim:

1. A shelf divider for use with a shelf arrangement including a lower shelf member and an upper shelf member spaced above the lower shelf member and defining a shelf space therebetween, comprising:

divider structure; and engagement structure associated with the divider structure, wherein the engagement structure is adapted to provide engagement of the divider structure with the lower shelf member when the shelf divider is in either a first orientation or a second orientation relative to the lower shelf member, wherein the shelf divider in its first orientation is adapted for placement within a shelf space having a first height and wherein the shelf divider in its second orientation is adapted for placement within a shelf space having a second height different than the first height, and wherein the engagement structure is further adapted to engage the upper shelf member when the shelf divider is in both its first orientation and its second orientation to provide lateral support to the divider structure when the shelf divider is in both its first orientation and its second orientation.

2. A shelf divider for use with a shelf arrangement including a lower shelf member and an upper shelf member spaced above the lower shelf member and defining a shelf space therebetween, comprising:

divider structure; and engagement structure associated with the divider structure, wherein the engagement structure is adapted to provide engagement of the divider structure with the lower shelf member when the shelf divider is in either a first orientation or a second orientation relative to the lower shelf member, wherein the divider structure is dimensioned so as to extend substantially the full height of shelf spaces of two distinct heights between the upper and lower shelf members when the shelf divider is positioned in either its first orientation or its second orientation, and wherein the engagement structure further provides lateral support to the divider structure when the shelf divider is in both its first orientation and its second orientation relative to the lower shelf member.

3. The shelf divider of claim 1, wherein the engagement structure comprises a series of tabs extending from edges defined by the divider structure, wherein the tabs are adapted for engagement within slots formed in the lower shelf member and in the upper shelf member when the shelf divider is positioned in either its first orientation or its second orientation.

4. A shelf divider for use with a shelf arrangement including a lower shelf member and an upper shelf member spaced above the lower shelf member and defining a shelf space therebetween, comprising:

divider structure; and engagement structure associated with the divider structure, wherein the engagement structure is adapted to provide engagement of the divider structure with the lower shelf member when the shelf divider is in either a first orientation or a second orientation relative to the lower shelf member, and wherein the engagement structure is further adapted to provide lateral support to the divider structure when the shelf divider is in both its first orientation and its second orientation relative to the lower shelf member;

wherein the engagement structure comprises a series of tabs extending from edges defined by the divider structure, wherein the divider structure defines a first pair of opposed edges and a second pair of opposed edges, and wherein the series of tabs comprises a pair of tabs extending from one of the edges in each of the first and second pair of opposed edges, and a stabilizing tab extending from an opposite one of the edges in each of the first and second pair of opposed edges, wherein the tabs are adapted for engagement within slots formed in the lower shelf member and in the upper shelf member when the shelf divider is positioned in either its first orientation or its second orientation.

5. The shelf divider of claim 4, wherein the slots formed in the lower shelf member comprise a pair of spaced rows of slots, wherein the slots in each row are adapted to receive one of the tabs in each pair of tabs when the shelf divider is in either its first orientation or its second orientation.

6. The shelf divider of claim 5, wherein the slots formed in the upper shelf member comprise a row of slots adapted to receive one of the stabilizing tabs when the shelf divider is in either its first orientation or its second orientation.

7. A shelf divider for use in a shelving cabinet including at least a lower shelf member, comprising:

divider structure comprising first and second oppositely-facing edges and third and fourth oppositely-facing edges;

a similarly configured engagement arrangement provided on each of the first and third edges; and a stabilizing arrangement provided on each of the second and fourth edges;

wherein the engagement arrangement of either the first edge or the third edge is adapted for engagement with the lower shelf member for engaging the shelf divider therewith, and wherein the stabilizing arrangement is adapted for engagement at a location spaced vertically above the lower shelf member with structure associated with the cabinet for providing lateral stability to the shelf divider, wherein the shelf divider is adapted for movement between a first orientation in which the shelf divider is supported by engagement of the engagement arrangement of the first edge and the stabilizing arrangement of the second edge, and a second orientation in which the shelf divider is supported by the engagement arrangement of the third edge and the stabilizing member of the fourth edge.

8. The shelf divider of claim 7, wherein the engagement arrangement of the first and third edges comprises a pair of spaced-apart tabs, wherein each pair of tabs extends from one of the first and third edges, and wherein the lower shelf member defines at least a pair of spaced-apart openings, each of which is adapted to receive one of the tabs in each pair of tabs when the shelf divider is in either its first orientation or its second orientation.

9. The shelf divider of claim 8, wherein the stabilizing arrangement comprises a stabilizing tab extending outwardly from each of the second and fourth edges, wherein each stabilizing tab is adapted for engagement with an opening associated with an upper shelf member when the shelf divider is in either its first orientation or its second orientation.

10. The shelf divider of claim 9, further comprising an angled edge extending between the second and fourth edges, wherein the angled edge is configured so as to face forwardly when the shelf divider is in either its first orientation or its second orientation.

11. The shelf divider of claim 8, wherein the pair of openings in the lower shelf member and the pairs of tabs extending from the first and third edges of the divider structure are configured so as to provide engagement of projection structure associated with each tab in each pair of tabs with an area of the lower shelf member adjacent an edge of each opening.

12. The shelf divider of claim 8, further comprising a pattern of openings formed in the divider structure offset from each other in both a vertical direction and a horizontal direction, wherein the openings are adapted to receive a backstop member and are offset in a forward-rearward direction and in a bottom-to-top direction when the shelf divider is in both its first orientation and its second orientation.

13. A method of dividing a first shelf space having a first height and a second shelf space having a second height, wherein each shelf space is defined at least in part by a lower shelf member, comprising the steps of:

providing a shelf divider having first engagement structure and second engagement structure; and engaging the shelf divider within one of the first and second shelf spaces, wherein engagement of the shelf divider within the first shelf space is carried out by placing the shelf divider in a first orientation relative to the lower shelf member of the first shelf space and engaging the first engagement structure with the lower shelf member of the first shelf space, and wherein engagement of the shelf divider within the second shelf space is carried out by positioning the shelf divider in a second orientation relative to the lower shelf member of the second shelf space, different than the first orientation, and engaging the second engagement structure with the lower shelf member of the second shelf space.

14. The method of claim 13, wherein the first and second engagement structures include first and second stabilizing tabs, respectively, and wherein the step of positioning the shelf divider within the first shelf space in the first orientation includes engaging the first stabilizing tab with an upper shelf member located above the lower shelf member and defining the height of the first shelf space, and wherein the step of engaging the shelf divider within the second shelf space is carried out by engaging the second stabilizing tab with an upper shelf member located above the lower shelf member and defining the height of the second shelf space.

15. The method of claim 14, wherein the first and second engagement structures each comprise a pair of similarly configured and spaced-apart tabs, wherein the pairs of tabs extend from adjacent edges defined by the shelf divider, and wherein the step of engaging the engagement structure with the lower shelf member is carried out by positioning the tabs in each pair of tabs within openings formed in the lower shelf member.

* * * * *